US006035954A

United States Patent [19]

Hipp

[11] Patent Number: 6,035,954

[45] Date of Patent: Mar. 14, 2000

[54] FLUID OPERATED VIBRATORY OIL WELL DRILLING TOOL WITH ANTI-CHATTER SWITCH

[75] Inventor: James E. Hipp, New Iberia, La.

[73] Assignee: Baker Hughes Incorporated, Houston, Tex.

[21] Appl. No.: 09/022,998

[22] Filed: Feb. 12, 1998

[51] Int. Cl.[7] ..... E21B 4/14

[52] U.S. Cl. ..... 175/296; 175/299

[58] Field of Search ..... 175/296, 299, 175/105, 305, 306

[56] References Cited

U.S. PATENT DOCUMENTS

| | | | |
|---|---|---|---|
| 3,898,815 | 8/1975 | Young | 175/321 X |
| 3,946,819 | 3/1976 | Hipp | 175/296 |
| 4,111,271 | 9/1978 | Perkins | 175/297 |
| 4,462,471 | 7/1984 | Hipp | 175/296 |
| 4,702,325 | 10/1987 | Hipp | 173/64 |
| 4,799,829 | 1/1989 | Kenny | 405/195 |
| 4,958,691 | 9/1990 | Hipp | 175/296 |
| 5,007,479 | 4/1991 | Pleasants et al. | 175/297 X |
| 5,156,223 | 10/1992 | Hipp | 175/296 |
| 5,562,170 | 10/1996 | Wolfer et al. | 175/296 |
| 5,595,244 | 1/1997 | Roberts | 175/296 X |
| 5,722,495 | 3/1998 | Rear | 175/296 |

*Primary Examiner*—Frank Tsay

[57] ABSTRACT

An impact driven oil and gas well tool for use with an elongated tubular string having a central flow conveying bore is provided for channeling pressurized fluid to the tool body. The apparatus further includes an elongated longitudinally extending tool body having a connecting end portion at its upper end for connecting the tool body to the pipe string. A fluid chamber in the tool body is provided that is in fluid communication with the pipe string bore. A stem is reciprocally movable within the tool body in a telescoping fashion. The stem includes a lower end portion for carrying a working member such as a drill. A pressure responsive valve is provided for controlling relative movement of the stem and the tool body. An anti-chatter annular sleeve is positioned in the fluid chamber and about the valve member. A spring extends between the sleeve and the valve member for holding the valve member off the seat until a predetermined flow rate through the tool body is reached.

10 Claims, 3 Drawing Sheets

FLUID OPERATED VIBRATORY OIL WELL DRILLING TOOL WITH ANTI-CHATTER SWITCH

BACKGROUND OF THE INVENTION

1. Field of the Invention

The present invention relates generally to downhole oil well tools run on a pipe string, such as impact, drilling, or jarring type downhole oil well tools, and more particularly, to a fluid operated tool for use in well bores wherein an anti-chatter switch prevents valve chatter when running into the well bore.

2. General Background of the Invention

In downhole well operations, there is often a need for jarring or impact devices. For example, in work over operations using a pipe string such as coil tubing or snubbing equipment, it is necessary to provide downward jarring impact at the bottom of the string to enable the string to pass obstructions or otherwise enter the well. During fishing operations or other operations, such as opening restriction (i.e., collapsed tubing) it is sometimes necessary to apply upward jarring or impact forces at the bottom of the string if the fishing tool or the like becomes stuck.

In prior U.S. Pat. No. 3,946,819, naming the applicant herein as patentee, there is disclosed a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil. The tool of prior U.S. Pat. No. 3,946,819, is effective in providing downward repetitive blows. The tool of the '819 patent will not produce upwardly directed blows.

In prior U.S. Pat. No. 4,462,471, naming the applicant herein as patentee, there is provided a bidirectional fluid operated jarring apparatus that produces jarring forces in either the upward or downward direction. The jarring apparatus was used to provide upward or downward impact forces as desired downhole without removing the tool from the well bore for modification. The device provides downward jarring forces when the tool is in compression, as when pipe weight is being applied downwardly on the tool, and produces strong upward forces when is in tension, as when the tool is being pulled upwardly.

In U.S. Pat. No. 4,462,471, there is disclosed a jarring or drilling mechanism that may be adapted to provide upward and downward blows. The mechanism of the '471 patent includes a housing having opposed axially spaced apart hammer surfaces slidingly mounted within the housing between the anvil surfaces. A spring is provided for urging the hammer upwardly. When it is desired to use the mechanism of the '471 patent for jarring, a valve including a closure and a compression spring is dropped down the string to the mechanism.

In general, the mechanism of the '471 patent operates by fluid pressure acting on the valve and hammer to urge the valve and hammer axially downwardly until the dowvnward movement of the valve is stopped, preferably by the full compression of the valve spring. When the downwvard movement of the valve stops, the seal between the valve and the hammer is broken and the valve moves axially upwardly.

The direction jarring of the mechanism of the '471 patent is determined by the relationship between the fluid pressure and the strength of the spring that urges the hammer upwardly. Normally, the mechanism is adapted for upward jarring. When the valve opens, the hammer moves upwardly to strike the downwardly facing anvil surface of the housing.

U.S. Pat. No. 5,156,223 discloses a fluid operated vibratory jar with rotating bit that uses impact, reciprocal drilling and an improved rotating bit or working member. That apparatus includes the receipt of both fluid pressure and weight from an elongated pipe string with a flow bore in order to drive the tool. A valve within the tool housing controls fluid pressure to the working end so that the tool pressures up, then releases pressure through the working member allowing the pipe string to load the bit, creating impact. A clutch is disclosed in the '223 patent that rotates the working member during drilling to prevent imprint upon the formation. A bias spring is provided to control and adjust the amount of weight on the bit independent of pipe weight. U.S. Pat. No. 5,156,223 is incorporated herein by reference.

When the prior tool of U.S. Pat. No. 5,516,223 is lowered into the well, it is neither in tension nor compression. But as the springs that deliver the energy for the upward blow are preloaded (compressed) between the piston and the housing during assembly, the piston is predetermined to rest at the top of its stroke.

The normal resting for the dart valving member places it very close to the seat. Therefore, any fluid pumped through the tool pulls the valving member on to the seat. The piston then begins to move down due to pressure build up in chamber. The piston pulls the dart valving member down with it as they are locked together by differential pressure across the seat.

As the dart valving member moves downward, it compresses the spring. When the upward forces building in the spring become greater than the force holding valving member to valve seat, the seal is broken. The dart valving member moves upward and the piston follows closely urged by the spring. The cycle begins again, resulting in chatter and seat wear.

BRIEF SUMMARY OF THE INVENTION

The present invention provides a well tool apparatus for use with an elongated pipe string that can load the tool transmitting impact thereto and with a flow bore for transmitting pressurized fluid to the tool.

The apparatus includes a tool housing that is connectable to the lower end of a pipe string so that it is in fluid communication with the pipe string. The tool housing defines at least one fluid chamber for receiving therein pressurized fluid that is transmitted from the pipe string.

A tubular stem having a flow channel therethrough communicates with the fluid chamber, the stem telescopically received by the housing for relative reciprocal movement therewith between a first "pressured up" unloaded position and a second "impact" loaded position, the stem having a valve seat thereon.

An impact receptive working member is attached during use to one end of the tubular stem for movement therewith between first and second positions. Impact is transmitted to the working member in a second impact position.

A dart valving member is carried in the housing for controlling the flow of pressurized fluid in the fluid chamber and reciprocally movable therein between first and second positions. The valving member is operable to relieve fluid pressure within the fluid chamber responsive to a predetermined movement of the stem relative to the housing, permitting relative movement of the stem and housing into the second impact position when the valving member seals the valve seat.

The present invention provides an anti-chatter switch is disposed within the fluid chamber for separating the valving member and valve seat when flow is at a first minimal preset flow rate. The anti-chatter switch preferably includes a sleeve that surrounds the valving member.

The valving member has an enlarged upper portion and the anti-chatter switch includes a sleeve that surrounds the valving member below the enlarged upper end portion thereof.

The anti-chatter switch includes a sleeve that surrounds the valve and a spring that is positioned around the valve and above the sleeve.

A pair of springs can be positioned respectively above and below the sleeve including an upper spring with end portions that engage the valving member and sleeve, and a lower spring with end portions that engage the sleeve and the tubular stem.

The tubular stem is an elongated member having upper and lower end portions and a valve seat at the upper end portion of the stem. The stem and valving member are movable downwardly within the tool housing with fluid pressure when the valve seats upon the valve seat, forming a seal therewith.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
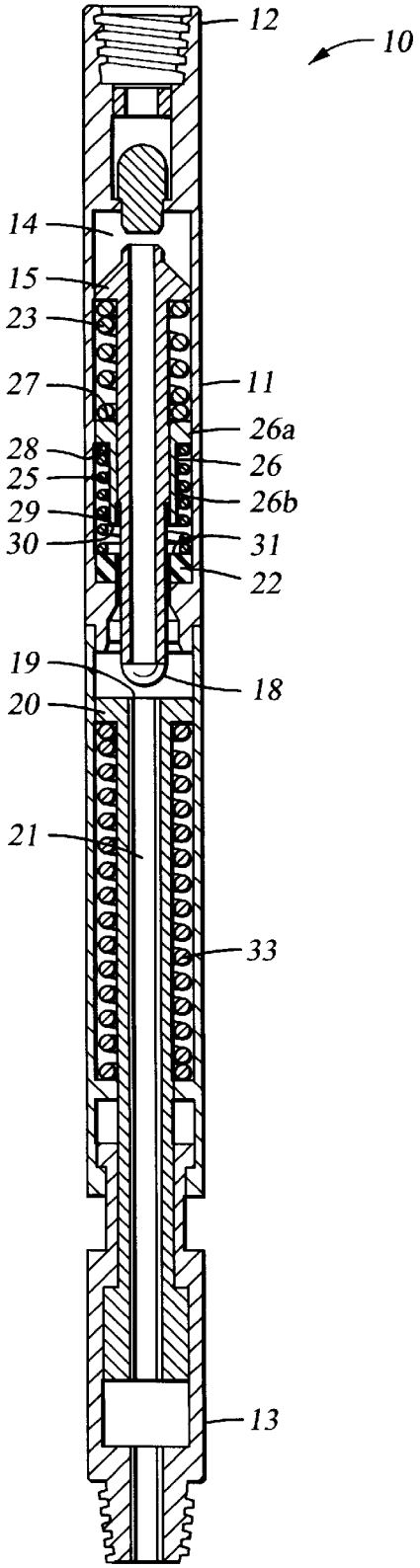
FIG. 1 is a sectional elevational viewer of the preferred embodiment of the apparatus of the present invention shown in circulating position with the valving member removed from the valve seat as when running into and out of the well bore.
Figure 2:
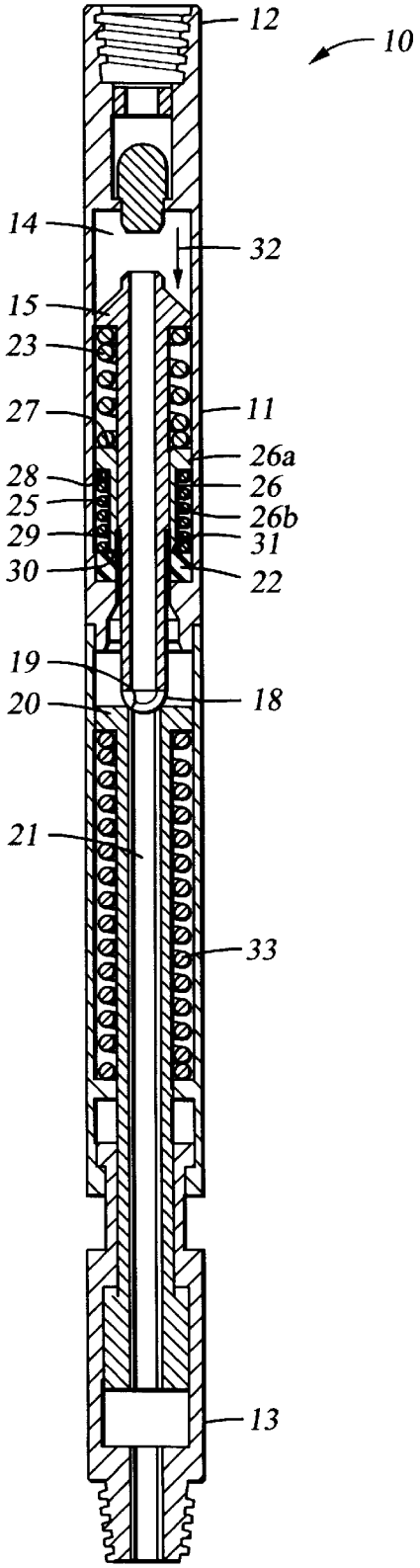
FIG. 2 is a sectional elevational of the preferred embodiment of the apparatus of the present invention shown once the flow has collapsed the spring, and the valving member seated upon the valve seat portion of the tool body.

FIGS. 1 and 2 show the preferred embodiment of the apparatus of the present invention designated generally by the numeral 10 in FIGS. 1 and 2. Well tool 10 includes an elongated tool body 11 having a proximal or upper end 12 and a distal or lower end 13. A tool bore 14 extends the full length of the tool body 11 for circulating fluid through the tool body 11 and in between its end portions 12, 13. Valving member 15 is slidably disposed within bore 14 as shown in FIGS. 1 and 2.

The valving member 15 moves from an upper position (FIG. 1) to a lower position (FIG. 2). In the upper position, a valving member end portion 18 of valve 15 is removed from seat 19. The valving member end portion 18 can be either hemispherically shaped or flat. In the lower position shown in FIG. 2, the valving member 15 surface 18 seats upon the valve seat 19 forming a closure therewith. In FIG. 1, a spring 25 of adjustable rate holds the valving member 15 off the valve seat 19 to allow through tool circulation into and out of the oil and gas well at a preset minimal flow rate. When the tool 10 is lowered into the wall, it is in neither tension nor compression. The springs that deliver the energy for the upward blow are preloaded (compressed) between the piston and the housing. The piston is predetermined to rest at the top of its stroke. The normal resting position for the valving member 15 or "dart" places valve surface 18 very dose to seat 19.

The spring 23 collapses to permit the valving member 15 to seat upon the valve seat 19 as shown in FIG. 2. As fluid is pumped through the tool body 11 via bore 14, valving member 15 travels from the initial position of FIG. 1 to the sealed position upon seat 19 in FIG. 2. Then, piston 20 begins to move down due to pressure build up in bore 14 above valving member 15 and seat 19. Piston 20 and valving member 15 move down together as differential pressure builds up above seat 19. As valving member 15 moves further down, spring 23 becomes more and more compressed. When the upward forces building in the spring become greater than the force holding valving member 18 to valve seat 19, the seal is broken. Dart 15 moves upward and piston 20 follows closely urged by spring 33. The cycle begins again, resulting in chatter and seat wear.

The present invention solves this problem by providing an anti-chatter switch arrangement that includes sleeve 26 and its spring 25 for holding the valving member 15 off the seat 19 to allow through tool circulation into and out of the well.

Figure 3:
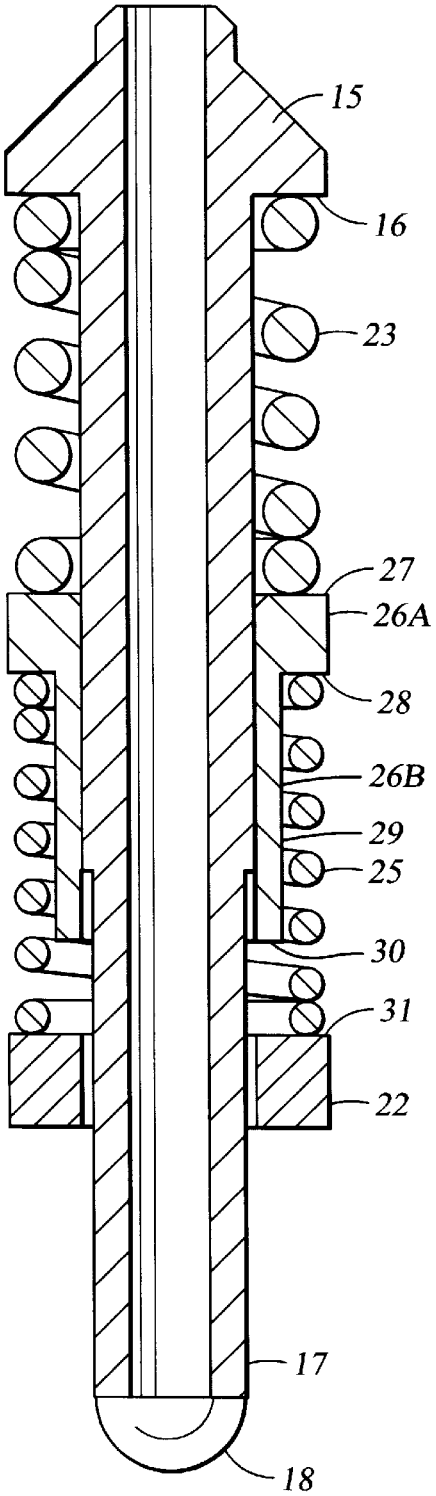
FIGS. 3 and 4 are fragmentary elevational views of the preferred embodiment of the apparatus of the present invention showing details of the valve, sleeves, and spring portions.
Figure 4:
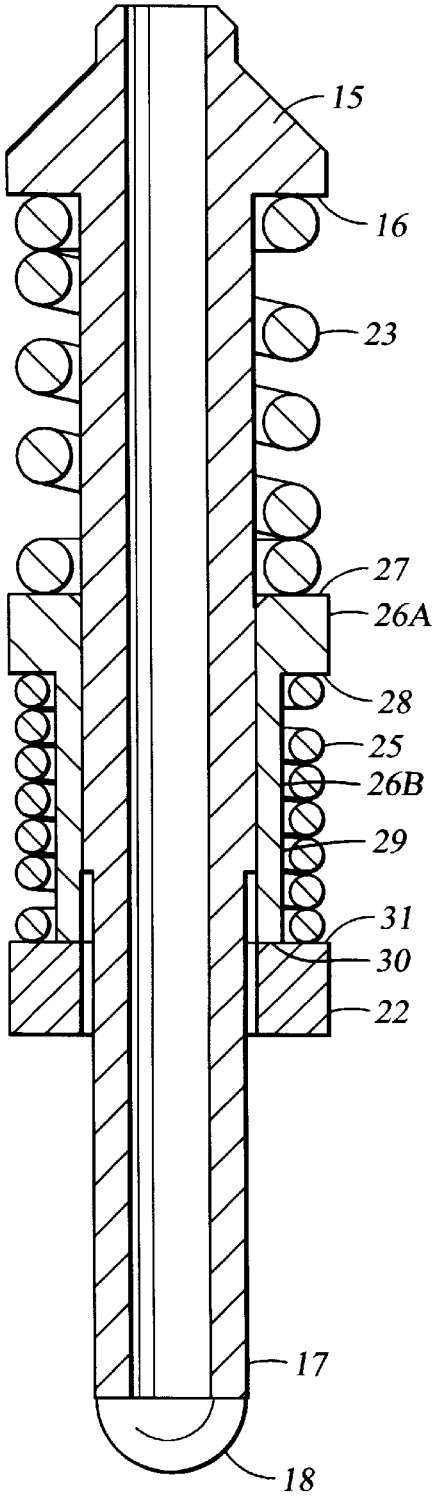

In FIGS. 3–4, valving member 15 has an annular shoulder 16 that receives the upper end of coil spring 23. Coil spring 23 bottoms against upper annular surface 27 of sleeve 26. The sleeve 26 has an enlarged diameter cylindrically-shaped upper end portion 26A and a smaller diameter cylindrically-shaped lower section 26B. Annular shoulder 28 defines the interface between enlarged diameter section 26A and smaller diameter section 26B.

Valving member 15 has a lower end portion 17 with hemispherically-shaped valve surface 18. The hemispherically-shaped valve surface 18 can form a closure with valve seat 19 at the upper end of piston 20. The piston 20 provides a cylindrically-shaped open ended flow bore 21 for communicating with the flow bore 14.

Coil spring 23 extends from surface 16 of valve member 15 to surface 27 of sleeve 26. Coil spring 25 extends from surface 31 of annular sleeve 22 to annular surface 28 of sleeve 26. The sleeve lower end 29 has an annular surface 30 that engages the surface 31 of annular sleeve 22 as shown in FIG. 2 once a predetermined flow rate is attained and spring 25 collapses. The springs 23 and 25 are of such an adjustable spring rate that they hold the valving member 15 off seat 19 to allow through tool circulation.

In FIG. 2, that predetermined spring rate has been overcome by flow through the tool body in the direction of arrow 32 in FIG. 2. This permits the valving member 15 and more particularly its valve surface 18 to seat upon the seat 19 permitting the apparatus 10 to run. By separating the valve surface 18 from seat 19 when running into the well bore, any chatter between the valve member 15 and the piston 20 is prevented.

Figure 5:
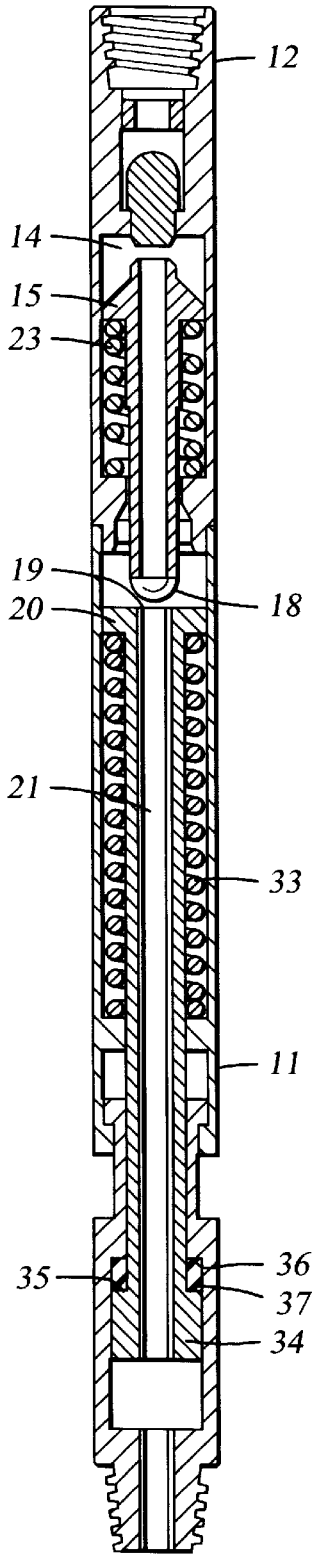
FIGS. 5–6 are sectional elevational views of a second embodiment of the apparatus of the present invention.
Figure 6:
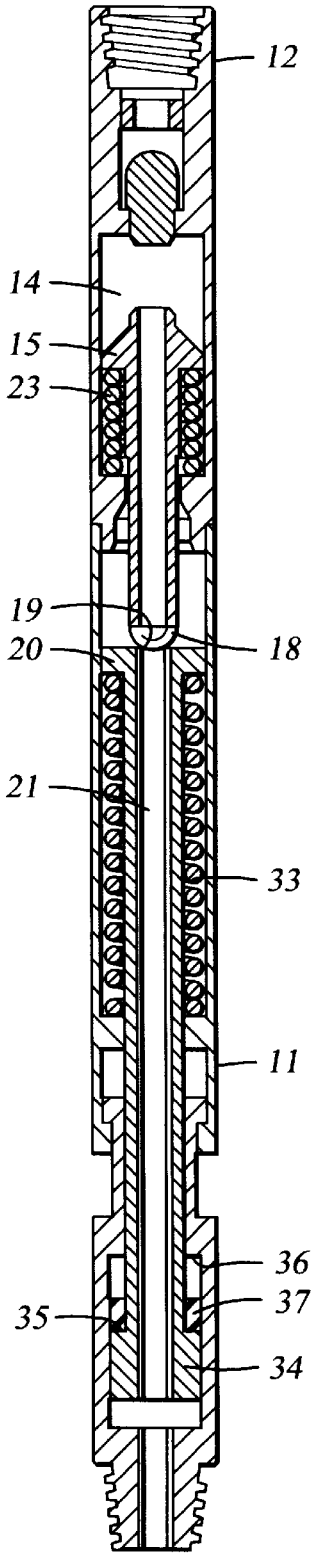

In FIGS. 5 and 6, a second embodiment of the apparatus of the present invention is shown, designated generally by the numeral 10A. In FIGS. 5 and 6, the valving member 15 seats at surface 18 when fluid flow through bore 14 pushes down on the valving member. As with the embodiment of FIGS. 1–3, piston 20 and valving member 15 separate when the upward forces building in spring 23 become greater than the force holding valving member 18 to valve seat 19 breaking seal. Then, valving member 15 moves upwardly urged by spring 23 and piston 20 moves upwardly urged by spring 33.

The lower end 34 of piston 20 is enlarged, having an annular shoulder 35 that is shaped to register against and strike annular surface 36 of tool body 11, creating an upward jarring blow.

In FIG. 5, removable, replaceable annular shock member 37 forms a shock absorbing interface that lessens metal fatigue in piston 34 at surface 35 and in housing 11 at surface 36. The annular member 37 is of a material that is softer than the material used to construct piston 20 and housing 11. The duration of impact is also increased.

The following is a list of suitable parts and materials for the various elements of the preferred embodiment of the present invention.

| Part Number | Description |
|---|---|
| 10 | well tool |
| 11 | tool body |
| 12 | upper end |
| 13 | lower end |
| 14 | flow bore |
| 15 | valving member |
| 16 | annular shoulder |
| 17 | lower end |
| 18 | valve surface |
| 19 | valve seat |
| 20 | piston |
| 21 | piston bore |
| 22 | sleeve |
| 23 | spring |
| 24 | annular sleeve |
| 25 | spring |
| 26 | sleeve |
| 26A | larger diameter section |
| 26B | smaller diameter section |
| 27 | annular surface |
| 28 | annular surface |
| 29 | sleeve lower end |
| 30 | annular surface |
| 31 | annular surface |
| 32 | arrow |
| 33 | spring |
| 34 | lower end |
| 35 | annular shoulder |
| 36 | annular surface |
| 37 | annular shock member |

The foregoing embodiments are presented by way of example only; the scope of the present invention is to be limited only by the following claims.

I claim:

1. A well tool apparatus for use with an elongated pipe string that can load the tool transmitting impact thereto and with a flow bore for transmitting pressurized fluid to the tool comprising:

a) a tool housing having means for connecting said tool housing in fluid communication with the lower end of a pipe string and defining at least one fluid chamber therein for receiving pressurized fluid transmitted from the pipe string thereto;

b) a tubular stem having a flow channel therethrough communicating with the fluid chamber, the stem telescopically received by said housing for relative reciprocal movement therewith between a first pressured up unloaded position and a second impact loaded position the stem having a valve seat thereon;

c) an impact receptive working member attached during use to one end of said tubular stem for movement therewith between said first and second positions, wherein impact is transmitted to the working member in the second impact position;

d) a valve carried in said housing for controlling the flow of pressurized fluid in the fluid chamber and reciprocally movable therein between first and second positions, said valve being operable to relieve fluid pressure within the fluid chamber responsive to predetermined movement of said stem relative to said housing, permitting relative movement of said stem and housing into said second impact position when the valve seals the valve seat; and e) an anti-chatter switch disposed within the fluid chamber for separating the valve and valve seat when flow is at a first minimal preset flow rate.

2. The well tool apparatus of claim 1 wherein the anti-chatter switch includes a sleeve that surrounds the valve.

3. The well tool apparatus of claim 1 wherein the valve has an enlarged upper end portion and the anti-chatter switch includes a sleeve that surrounds the valve below the enlarged upper end portion of the valve.

4. The well tool apparatus of claim 1 wherein the anti-chatter switch includes a sleeve that surrounds the valve and a spring is positioned around the valve and above the sleeve.

5. The well tool apparatus of claim 4 wherein a pair of springs are positioned respectively above and below the sleeve including an upper spring with end portions that engage the valve and the sleeve and a lower spring with end portions that engage the sleeve and the tubular stem.

6. The well tool apparatus of claim 1 wherein the tubular stem is an elongated member having upper and lower end portions with the valve seat at the upper end portion of the stem, and wherein the stem and valve are movable downwardly within the tool housing with fluid pressure when the valve seats upon the valve seat, forming a seal therewith.

7. The well tool apparatus of claim 1 wherein the anti-chatter switch includes a spring member that holds the valve off of the valve seat.

8. The well tool apparatus of claim 7 wherein the spring member is a coil spring.

9. The well tool apparatus of claim 7 wherein the spring member is a cylindrically-shaped spring positioned inside of the housing and surrounding the valve.

10. An impact, driven well tool for use with an elongated tubular pipe string having a central flow conveying bore for channeling pressurized fluid to the tool, comprising:

a) an elongated longitudinally extending tool body having means for connecting the tool body to the pipe string;

b) a fluid chamber in the tool body in fluid communication with the pipe string bore;

c) a stem reciprocally movable within the tool body in a telescoping fashion, the stem having a lower end portion for carrying a working member;

d) a pressure responsive valve and valve seat for controlling relative movement of the stem and tool body;

e) an anti-chatter annular sleeve positioned in the fluid chamber and about the valve; and f) a spring that extends between the sleeve and the valve for holding the valve off the seat until a predetermined flow rate through the tool body is reached.

* * * * *